United States Patent [19]

McHugh

[11] 3,940,052

[45] Feb. 24, 1976

[54] UNITARY CONTAINER LINER

[76] Inventor: Vincent Kenneth McHugh, 4533 Granville Court, Toledo, Ohio 43615

[22] Filed: Apr. 29, 1974

[21] Appl. No.: 465,296

Related U.S. Application Data

[63] Continuation-in-part of Ser. No. 195,193, Nov. 3, 1971, abandoned.

[52] U.S. Cl. ..... 229/14 BE; 229/14 B; 220/63 R

[51] Int. Cl.[2] ..... B65D 5/40; B65D 25/14

[58] Field of Search ..... 229/14 B, 14 BE, 14 BW; 220/63 R, 65

[56] References Cited

UNITED STATES PATENTS

| | | | |
|---|---|---|---|
| 2,511,481 | 6/1950 | Schneider | 229/14 BE |
| 2,721,674 | 10/1955 | Lazard | 220/63 R |
| 2,748,673 | 6/1956 | Winstead | 229/14 BE X |
| 2,771,221 | 11/1956 | Hammond et al. | 220/63 R X |
| 2,861,714 | 11/1958 | Glossop | 220/63 R |
| 3,137,433 | 6/1964 | Lipschutz et al. | 229/14 BE |
| 3,321,070 | 5/1967 | Childs | 229/14 B X |

FOREIGN PATENTS OR APPLICATIONS

| | | | |
|---|---|---|---|
| 207,784 | 9/1954 | Australia | 220/63 R |

*Primary Examiner*—Davis T. Moorhead
*Attorney, Agent, or Firm*—David H. Wilson

[57] ABSTRACT

A liner has a thin pliant tubular portion and a stiff base generally conforming to the bottom of a container into which it is inserted and capable of disposing the tubular portion against the walls of the container. The liner is disposed in intimate contact with the container upon the filling of the liner with a liquid material and the free open end of the liner is sealed against the container to maintain the liner in intimate contact therewith and prevent collapse of the liner upon agitation and dispensing of the liquid.

3 Claims, 11 Drawing Figures

INVENTOR.
VINCENT KENNETH McHUGH
BY
Wilson & Fraser
ATTORNEY

UNITARY CONTAINER LINER

CROSS-REFERENCES TO RELATED APPLICATIONS

This is a continuation-in-part of U.S. Pat. application Ser. No. 195,193 which was filed Nov. 3, 1971 and is entitled "A Container Liner and Method of Applying the Same" now abandoned.

BACKGROUND OF THE INVENTION

Containers for storing fluids have generally been of the disposible type but recently greater emphasis has arisen concerning the reuse of such containers. Reuse of the container is particularly desirable where the container is large and represents a substantial investment in its initial cost. Generally, such containers must be cleaned before reuse to avoid contamination by the coating and/or residuals left in the emptied container from its previous use. The inside of the container may be coated with an inert material which will not react with the material to be contained and can have a characteristic which would tend to militate against the adherence by the contained material. Cleaning and coating of such containers is a nuisance and in many instances raises the cost to exceed the cost of a new container thereby justifying disposal of the old container and the purchase of a new container.

Attempts at an economical solution to permit the reuse of containers have included the use of disposable liners such as plastic bags. The bags are preferrably of a thin pliable wall to minimize space requirements and provide for easy manipulation upon removal.

An example of a container for liquids is a 55-gallon paint drum which can be equipped with a cover for sealing the top of the drum when the paint is transported and/or stored. The container cover may be replaced, when the paint is to be used, by a cover having an integrally mounted pump and agitator mounted thereon. The pump cover is removable for use on a plurality of drums. The pump on the pump cover is used to dispense the paint and the agitator is used to mix the paint. One of the problems associated with the use of disposable liners in general and with the above paint drum in particular is the collapse of the liner upon dispensing of the paint. In the closed drum with a dispensing pump, in particular, liner collapse can occur because of the vacuum produced in the drum by removal of the paint by the pump. The vacuum is desirable from the standpoint of preventing oxidation of the paint by air which would otherwise fill the space vacated by the paint.

The collapse of the liner results in the liner being pulled to the inlet of the pump where the impervious liner blocks the inlet upon contact with it and prevents the flow of paint.

Another problem is the tendency of the liner to shift within the drum when the drum is treated roughly in shipping, or when the paint is agitated or mixed, each of which can result in the tearing of the liner. Further, where air pockets have formed between the liner and the drum, particularly at the intersection of the bottom of the drum and the side walls, a shifting of the liner can cause movement of the air pockets whereby the liner is moved away from the drum toward the agitator and can be torn by the agitator upon contact therewith. The problem of shifting of the liner becomes even more acute as the level of liquid is lowered within the drum and the forces resulting on the liner from agitation and the vacuum within the drum are combined and act simultaneously on the liner.

Prior art liners having closed bottoms secured in a container have required assembly of a multiplicity of elements in the container while the liner is maintained in position. This labor increases the cost and reduces the advantage of container economy sought through use of a liner. It also is subject to faulty installation of the liner and ultimate failure of its intended function. Removal of the liner elements is complicated by such assemblies in that retainer elements both internal of the liner and external of the liner must often be separately removed to enable the liner to be removed, particularly where it is desired to avoid rupture of the liner and the contamination of the container by the residual liquids in the liner.

Liners installed in metal drums are prone to rupture during installation where they fit the container walls. Even if installed without mechanical perforation, with many of the fluids desired to be contained in reuseable containers having liners chemical penetration of the liners particularly at seams and bonded areas can be a problem. Thus mechanical protection of liners during their placement in a container and precautions against weakened seams or seams vulnerable to chemical attack are desirable.

The above problems are overcome by the present liner which militates against collapse of the liner while in use, entrapment of air between the liner and the container and shifting of the liner relative to the container by use of a specially adapted base for the liner which stabilizes the position of the liner relative to the container and prevents air pockets from forming between the liner and the container.

In a preferred embodiment of a liner according to this invention the liner is of unitary construction to facilitate installation in a container and removal therefrom once the liquid constrained from the container walls by the liner has been withdrawn. Seam construction and bonds to the pliant sheet material of the liner are arranged for maximum integrity against liquid leakage. This embodiment of a liner is provided with a bottom having such stiffness and collapse resistance as to be adapted to accommodate suction withdrawal and mechanical agitation of liquid contained thereby in the vicinity of the bottom without displacement into the agitator or the suction inlet.

SUMMARY OF THE INVENTION

The present invention relates to liners for containers and a method of lining a container with a replaceable liner, and more particularly to a liner having a base opposite the open end thereof for use in containers for transporting, storing, and dispensing fluids. The containers have side walls to which a pliant collapsible tubular portion of the liner conforms and a bottom to which the base conforms. The tubular portion has an opening in one end thereof and the base on the other end. The periphery of the base substantially conforms to the periphery of the bottom of the container and is typically of a smaller diameter than that of the container bottom to provide clearance between the periphery of the base and the side walls of the container for passage of the base. The base is formed of a generally stiff material to maintain the main portion of the liner body in conformity with the side walls of the container and prevent the liner from collapsing upon withdrawal and agitation of the contained fluid. The liner is formed of material which is impervious and inert to the fluid to be disposed in the container to maintain separation between the fluid and the container. The liner, particularly the tubular portion, is caused to conform to the container when the fluid is poured into the positioned liner. With the free end of the tubular portion of the liner loosely draped over the upper rim of the container, air is allowed to escape from between the liner and the container and accordingly facilitates the liner being brought into intimate contact with the inner surface of the container. The free end of the tubular portion of the liner is subsequently sealed to the outer surface of the container to prevent air from re-entering the area between the liner and the container to maintain the liner in intimate contact with the container.

A preferred form of liner is of a tube of fusible plastic sheet of a pliant collapsible nature closed by fusing the plastic sheet at one end to form a liquid impervious bag. A heavier sheet of fusible plastic material which in its major face is of the general form of the container bottom in which the liner is to be mounted is bonded around its periphery to the closed end of the pliant sheet material to stiffen the bottom of the liner. Such an inner stiffner should have sufficient resistance to bending as to prevent the displacement of the liner into a suction inlet positioned adjacent the liner to withdraw the liquid contained by the liner. It should also resist displacement by the forces of the liquid currents induced by agitators of the type employed to place paint pigment in suspension when operated within the liquid in the liner.

The bond between the internal stiffner and the closed end of the liner tube is formed by fusion between the internal stiffner and the plastic sheet of the tube wall. In order to avoid thinning of localized areas of the tube wall during fusion bonding, care is exercised to form fusion joints only on single layers of plastic sheet. Where an essentially straight fusion seam is formed across the end of a tube to form a sealed closed end the length of the seam is about half the circumference of the tube and thus substantially $$\frac{\pi d}{2} - d$$

greater than the diameter $d$ of the tube in length. A convenient geometry to accommodate a circular bottom involves folding an ear of the sheet material of a length $$\frac{\pi d}{4} - \frac{d}{2}$$

inward at each end of the seam. This folded material makes a multiple layer of sheet material over a portion of the inner liner. An effective assembly technique is to develop fused bonds along lines in the areas other than the folds and ears thereby avoiding application of fusion energy over multiple layers and reducing the probability of concentrated energy on limited areas which might tend to be weakened thereby. Additional folds of ears can be made to establish a form for the closed end of the liner which approaches a circle.

An external stiffner for the base of the liner is also employed in one preferred embodiment in order to cover the folds employed to conform the liner base to the circular bottom of a container thereby dressing the appearance of the liner, to mechanically protect and constrain those folds, to increase the stiffness of the base and permit the inner stiffner to be of thinner material and thus less expensive, and to protect the liner by virtue of the slight overhang of the external stiffner beyond the perimeter of the internal stiffner and its enclosing liner portions. An advantageous form of outer stiffner is a corrugated paper board adhered to the base of the liner and over the folded ears by means of a water base latex glue.

The liner installed in the above manner results in a container lined with a replaceable liner which allows the container to be reused without expensive coating or cleaning. The liner is easily removed because it has a collapsible tubular portion, but the tubular portion is maintained in intimate contact with the inner surface of the container to militate against collapse of the liner when the fluid therein is dispensed or agitated.

BRIEF DESCRIPTION OF THE DRAWINGS

The above objects and advantages of the invention will become readily apparent to one skilled in the art from reading the following detailed description of an embodiment of the invention when considered in the light of the accompanying drawings; in which.

DESCRIPTION OF THE PREFERRED EMBODIMENT

Figure 1:
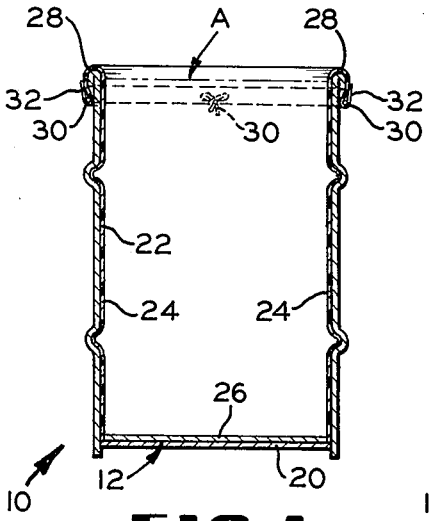
FIG. 1 is a sectional view of a container suitable for use with a liner in accordance with the present invention.
Figure 2:
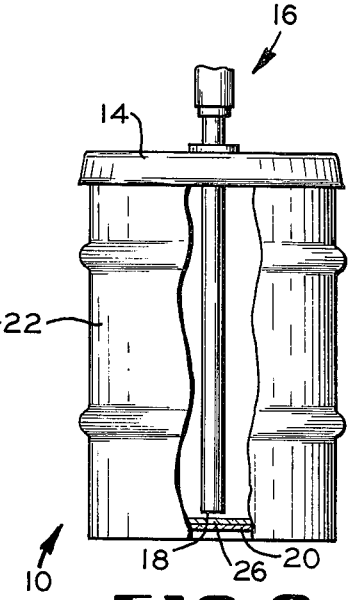
FIG. 2 is a fragmentary elevational view of a closed container suitable for use with a liner in accordance with the present invention with portions cut away to reveal greater detail.

FIGS. 1 through 7 illustrate a container in the form of a 55 gallon drum and a liner 12 adapted to substantially conform to the inside surface of the drum 10. In FIG. 2, the drum 10 has a cover 14 with an integrally mounted vertical pump 16 (partially illustrated) for dispensing paint stored within the drum 10. The cover 14 seals the drum 10 to prevent air from entering the drum which could affect an oxidation of the paint or evaporation of solvent or other chemical. For purposes of storage and transportation a similar cover without a pump is used to seal the drum. Where the drum 10 is maintained under a seal and the pump 16 is used to withdraw paint from the drum 10, a vacuum is created in the drum 10 as the paint is discharged. An inlet 18 on the bottom of the pump 16 is located in close proximity to the bottom 20 of the drum 10 in order to withdraw as much paint as possible. In addition, an agitator (not illustrated) can also be mounted on the cover 14. Typically, the agitator comprises an impellar on the end of a drive shaft extending into the drum 10 along side walls 22 on the drum 10. The agitator is used to mix the paint within the drum 10 to obtain a homogeneous mixture and, therefore, must create vigorous movement of the paint within the drum 10. The mixing occurs normally upon first use of the paint and subsequently thereafter whenever the paint has been stored for a period of time.

Other types of containers would be equally suited for use with a liner such as will be presented herein, including those which are open at the top, of a different cross-sectional shape and different size, but all of which have a bottom 20 and side walls 22. Further, the container may be for materials other than paint, including liquids generally and fluids of the flowable particle type for example, powdered or granular particles.

The liner 12 basically includes a thin walled tubular portion 24 and a base 26, illustrated in FIG. 1, with the tubular portion 24 conforming to the shape of the side wall 22 and the base 26 conforming to the shape of the bottom 20 of the drum 10. The liner 12 is in the operative position with the drum 10 filled with paint to the level indicated at A. Fluid pressure of the paint in the drum forces the liner 12 outwardly against the confines of the inner surface of the drum.

Figure 3:
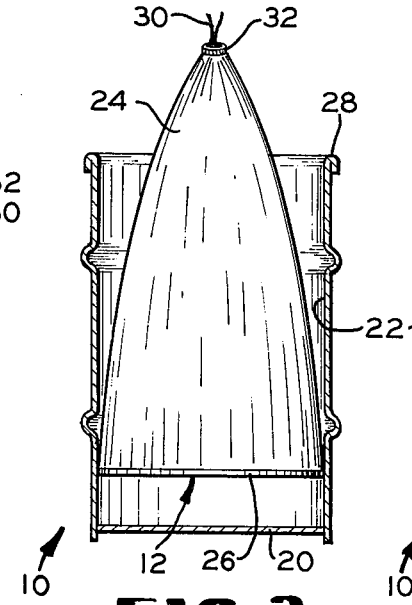
FIG. 3 is a view similar to that of FIG. 1 with the liner illustrated as partially removed from the container.

FIG. 3 illustrates the liner 12 being removed after the drum 10 has been emptied with the tubular portion 24 of the liner 12 partially collapsed upon itself. The dimensions of the base 26 are preferrably slightly smaller than the periphery of the bottom 20 of the drum 10 to allow the base to pass through the drum 10 as well as to be inserted therein.

The base 26 is formed of a generally stiff material. The characteristics of the base 26 and its tendency to resist bending are particularly advantageous in that the base 26 is the portion of the liner 12 located in close proximity to the inlet 18 of the pump 16. The stiffness of the base prevents the liner from being drawn against the inlet 18 and, therefore, maintains the flow of paint from the drum. The base 26 should have its major dimension in one plane with the dimension normal to the major dimension being minimized to conserve space within the drum 10 and make the base 26 non-obtrusive. The shape of the base in the plane of its major dimension conforms to the configuration of the bottom of the drum 10.

In applications where the pump is not held in fixed relation to the bottom of the drum 10 or a similar container and in which, therefore, an inlet may come in contact with the base 26, the base 26 may be embossed on the surface adjacent the inlet, such as inlet 18 of FIG. 2. Embossing the base 26 produces raised portions on the surface thereof which prevents the inlet from sealing against the base even upon coming in contact with it to thereby militate against interruption of flow of fluid material to the pump.

The clearance between the periphery of the base 26 and the side walls 22 of the drum 10 is preferrably just sufficient for passage of the base 26 therein. Controlling the amount of the above clearance together with the conformity of the shape of the base 26 to the shape of the bottom 20 of the drum 10 results in the tubular portion 24 of the liner 12 being positioned immediately adjacent the side walls 22 at the bottom of the drum 10 when the base 26 is placed in position within the drum 10. The tubular portion 24 is a thin pliant layer or film which is readily collapsible. The ability to collapse makes the tubular portion 24 particularly adapted to insertion and removal from the drum 10. Further, the pliant characteristic of the tubular portion 24 permits the portion 24 to readily conform to the side walls 22 of the drum. The degree of conformity of the tubular portion 24 to the side walls 22 depends on the alignment of the liner 12 within the drum 10. Preferrably, the tubular portion 24 is free from wrinkles, overlap and non-conforming curvature to prevent entrapment of air between the liner 12 and the drum 10. The stiff base 26 automatically disperses the tubular portion 24 about the periphery of the drum 10 upon being inserted therein. If the tubular portion 24 is subsequently drawn upwardly to overlap the drum lip 28 the liner is aligned in proper orientation over the entire inner surface of the drum 10, see FIG. 1.

In addition, the base 26, due to the small clearance between it and the side walls 22, prevents a non-conforming curvature of the liner 12 from forming at the intersection between the bottom 20 and side walls 22 of the drum 10. The liner 12 fits snugly into the corner because the base 26, being of a stiff nature, can maintain the proper orientation of the liner 12. Thus, the liner 12 militates against the forming of air pockets between it and the drum 10.

It is to be understood that any air which accumulates between the liner 12 and the drum 10 whether it is a result of wrinkling or failure of the liner 12 to conform prevents intimate contact of the liner 12 with the drum 10. When the liner 12 is not in intimate contact with the drum 10 the tubular portion 24 being of a pliant nature is free to move. Should the paint in the drum be agitated the liner which is free to move will be drawn together with the paint toward the agitator. Contact between the liner 12 and the agitator will tear the liner 12 contaminating the drum 10 and injecting fragments of the liner 12 into the paint. Further, freedom of the liner 12 to move relative to the drum 10 can result in twisting of the liner 12 about an axis passing longitudinally through the center of the drum 10 when the paint is stirred in a circular motion. Since the tubular portion 24 of the liner is thin, the above twisting motion can tear the liner. A base 26 with sufficient mass can militate against the twisting of the liner by the inertia force of the mass resisting the force applied to the liner 12 by the movement of the paint.

The liner 12 is particularly adapted to a method of lining the drum 10 to prevent entrapment of air between the liner 12 and the drum 10. First, the liner 12 is inserted in the drum with the base 26 oriented downwardly to contact the bottom of the drum 10. The tubular portion 24 of the liner 12 is drawn upwardly to conform the tubular portion 24 to the side walls 22 of the drum 10 and draped loosely over the upper rim of the drum 10 formed by the lip 28. The paint is poured into the drum and the pressure of the fluid forces the air from between the liner 12 and drum 10 past the rim of the drum 10 where the loosely draped liner 12 allows the air to escape. When the drum 10 has been filled to the level indicated at A in FIG. 1, the liner 12 has been brought into intimate contact with the drum 10. The liner 12 is now tied against the container by tightening a draw string 30 within a hem 32 on the open end of the tubular portion 24 and, further, may be sealed to the container, as by a cover, to prevent air from re-entering the area between the liner 12 and drum 10. Where a cover 14 is used, the liner is sealed between the cover 14 and the lip 28 where the cover has a pressure or compression fit with respect to the drum 10.

The draw string 30 makes it convenient to dispose of the used liner 12 by providing means for closing the open end of the tubular portion 24 when removing the liner 12 as illustrated in FIG. 3. Other means for sealing the liner could be used including wire, tape and cord and the liner 12 need not be hemmed to be sealed.

When the drum is lined as described above, the subsequent removal of paint still creates a vacuum within the drum 10, but the vacuum is offset by the vacuum created between the liner 12 and the drum 10. The latter vacuum prevents collapse of the liner and maintains it in intimate contact with the drum 10 until the seal between the liner and the side walls 22 or rim is broken. With the seal broken, the liner 12 can be readily collapsed and removed for replacement with a new liner.

In a preferred embodiment, the liner 12 is a tubular portion 24 of polyethelene plastic and the base 26 is a plastic disc both of which are impervious and inert to the liquid within the drum 10.

An example of a specific liner 12 would be a tubular portion 24 of pliant polyethelene plastic of a thickness of 4 mils and a stiff plastic disc of polyethelene of a higher density than the tubular portion 24 having a thickness of 50 mils.

Figure 4:
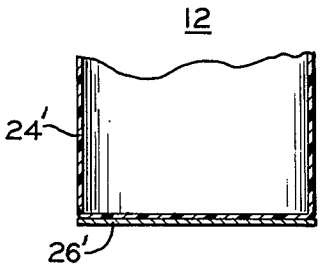
FIGS. 4 – 7 are modifications of the liner illustrated in FIGS. 1 and 3.
Figure 5:
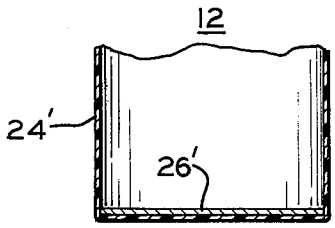
Figure 6:
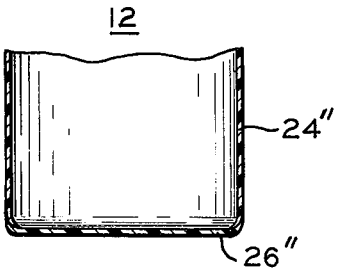
Figure 7:
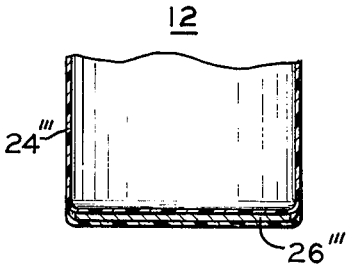

FIGS. 4 through 7 illustrate modifications of the liner 12 wherein a tubular portion 24' is closed at the end opposite the opening therein and a base 26' is attached to the closed end on the outside thereof in FIG. 4 and to the inside in FIG. 5 to obtain the liner 12 described above. It is to be understood that any base 26 could be attached by adhesives, heat sealing or any other convenient means and could also be of shapes other than a disc, for example, an annulus. FIG. 6 illustrates a base 26'' of the disc type which is integral with and of the same material as the tubular portion 24'' with the disc being of a denser stiff composition while the tubular portion is thin and pliant. Still another variation would be to seal a base 26''' in the form of a disc between two layers of the thin pliant material used for the tubular portion 24''' as illustrated in FIG. 7. All of the above modifications have the characteristics described above for the liner 12 including the conforming base 26 which disposes the tubular portion 24 adjacent the side walls of a container.

Where the base 26 was of a density sufficiently heavy so as not to float within the fluid, for example a metallic disc, the base in FIG. 5 could be independent of the tubular portion 24 and simply be placed on top of the closed end of the tubular portion. Where necessary, the base 26 which is independent could be removably attached to the tubular portion as by tape or other suitable fasteners. It is to be understood that the independent anchor disc type base 26 could be affixed to the outside of the tubular portion 24 as well and thus become reuseable with only the tubular portion being replaced.

It has been found advantageous to construct liners in unitary form so they are easily installed in containers and removed therefrom. Preferred forms of unitary liners are disclosed in FIGS. 8 through 11. These liners are arranged to fit within a drum such as the 55 gallon drum discussed above in a manner such that the liner is held near its open end and its base is dropped through the open end of the drum toward the bottom of the drum while the drum stands on its bottom.

Figure 8:
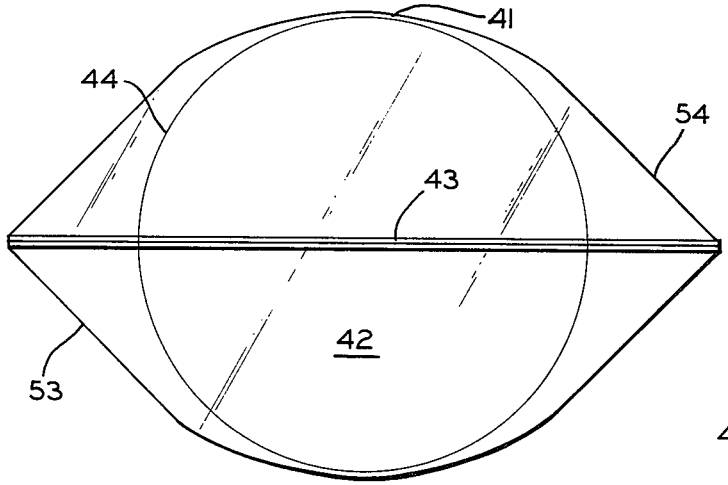
FIG. 8 is a bottom view of a partially assembled liner according to a preferred embodiment of this invention.

FIG. 8 illustrates an advantageous construction of the liner wherein a seamless tubular length 41 of polyethelene is closed at one end 42 by means of a fused seam 43 which can extend straight across the tube normal to its axis. Fusion can be accomplished with heat or by ultrasonic techniques. Such bonding has been found superior to cement or solvent bonds in those applications where the liquid to be contained includes constituents which may attack cement or solvent bonds.

With the liquid tight integrity of the liner established by seam 43, the base of the liner is formed by mounting an internal stiffner 44 in the closed end 42 of the liner. Internal stiffner 44 is of a stiff, collapse resistant, generally planar form as in the case of element 26' of FIG. 5. Where a pliant sheet material such as 4 mil polyethelene is employed as the tubular portion 41 an internal stiffner 44 of polyethelene having a thickness about an order of magnitude greater than the tubular portion thickness, 30 to 50 mils thick, will provide the means preventing the displacement of any portion of the liner into the suction inlet 18, shown in FIG. 2, as liquid is withdrawn or into the impellers (not shown) as the liquid is agitated and currents set up therein to intermix its constituents. The internal stiffner 44 is bonded to the closed end portion 42 in areas extending substantially around the periphery of the stiffner in the unitary liner construction to fix the spatial relationships of the pliant side wall 41, the closed end portion 42, and the inner stiffner 44 so that the liner is adapted to accommodate suction withdrawal and mechanical agitation of liquid contained in the vicinity of the container bottom. The internal stiffner 44 is characterized as being stiff and non-collapsible throughout its planar dimension under the forces imposed in the manipulation of the liquid contents of the liner including the suction withdrawal and mechanical agitation of that liquid.

Bonding of the pliant, fusible, sheet material of the tubular side walls 41 and closed end portion 42 to the thicker, fusible, internal stiffener 44 is accomplished by fusion along sector defining lines 45, 46, 47, 48, 49 and 51, where the stiffener 44 is circular in its major plane, to accommodate and fit within a circular drum 10. It has been found that thermal fusion or ultrasonic fusion is most effective when applied to a single layer of the pliant fusible sheet, and that where multiple layers of that sheet are subjected to the fusion process, the concentration of heat and/or pressure on the overlapped, thicker areas of material tend to thin or even penetrate the walls of the liner thereby reducing or destroying its integrity. Accordingly, a pattern of folds has been utilized to present single layers of the pliant sheet overlying the internal stiffener.

Figure 9:
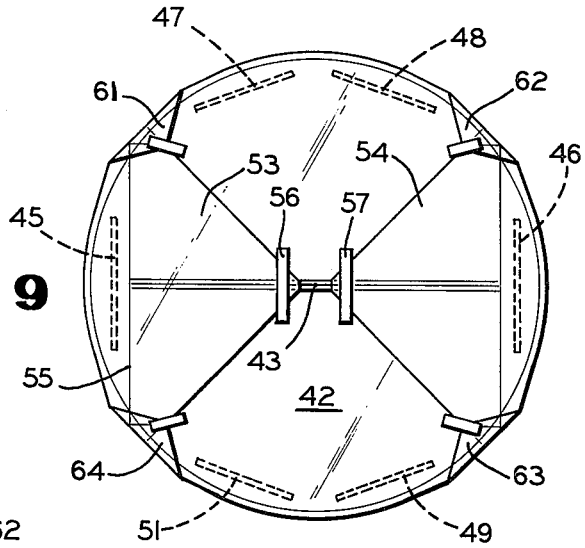
FIG. 9 is a bottom view of an assembled liner according to the embodiment of FIG. 8.

FIG. 9 illustrated the bottom of an assembled liner where the diametrically opposed extensions or ears 53 and 54 formed by the seam 43 are folded inward upon the stiff base formed by internal stiffener 44. The ears 53 and 54 are folded so that a sector of the internal stiffener 44 has only a single layer of the pliant, thinner, sidewall material to accommodate a fusion bond to the internal siffener 44 at 45 and 46 respectively. The fold of the ear 53 is represented as a sector line 55 in FIG. 9 beyond which the side wall material overlies the internal stiffener 44 in three or more layers. In the process of assembly of the liner the primary ears 53 and 54 are secured in place, conveniently by pressure sensitive tape 56 and 57.

The folding of the primary ears only begins to cause the closed end 42 to approximate the circular outline of internal liner 44. A closer approximation is realized by folding inward four secondary ears 61, 62, 63 and 64 which result from the folding inward of the end portions of the primary ears 53 and 54. Again these secondary ears are secured by pressure sensitive tape and are folded to present substantial areas in which only a single layer of side and end wall sheet material overlay the internal stiffener 44. In these single layer areas fusion bonds are formed along lines 47, 48, 49 and 51 to complete a distribution of bond lines between the pliant sheet material of the tubular portion 41 and closed end wall 42 to the internal stiffener 44 over substantially its entire periphery and sufficiently distributed around its periphery as to prevent displacement of the pliant material into the base region of the liner as that base is defined by internal stiffener 44.

Figure 10:
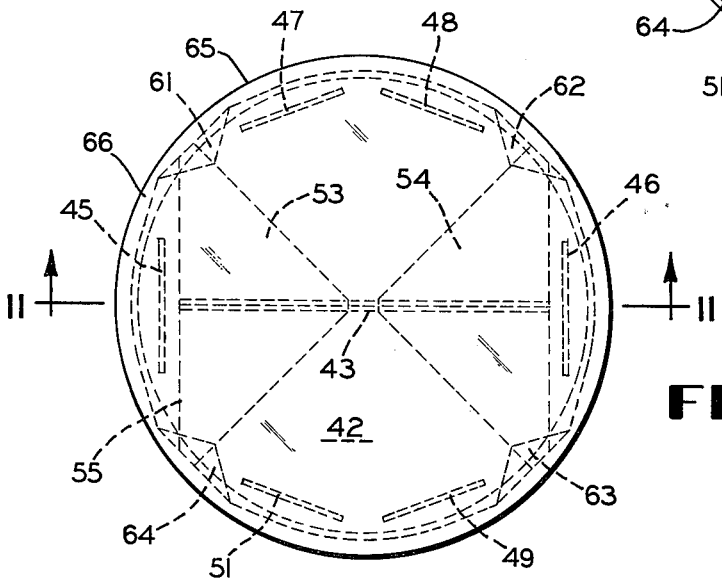
FIG. 10 is a bottom view of an extension of the liner structure of FIGS. 8 and 9 which offers certain advantages over the assembled form of FIG. 9.
Figure 11:
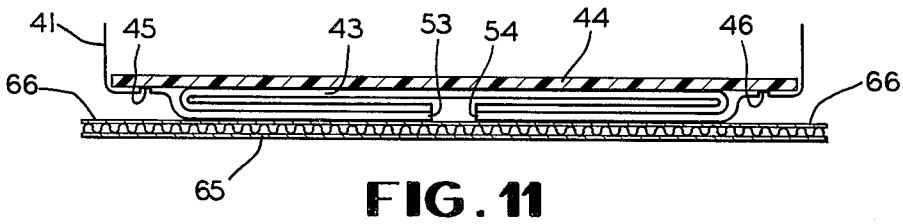
FIG. 11 is a sectional elevational view of the lower portion of the liner with a base portion of the liner taken along lines 11—11 of FIG. 10 and increased in scale with wall thickness of the pliant sheet side and end walls represented as single lines to facilitate illustration of the invention.

Internal stifener 44 can be reinforced externally of the closed end wall 42. Such reinforcement offers a number of advantages as illustrated in FIGS. 10 and 11. A stiff board of a material less expensive than that of the internal stiffener 44, for example corrugated paper board, can be applied as an external stiffener 65 for the liner base. External stiffener 65 can be generally planar and of the shape of internal stiffener 44. Its dimensions should, of course, permit it to be dropped without interference into the container in which the liner is to be mounted. Since metal drums can have rough areas or burrs on their internal surface along their side walls and bottoms, the external stiffener 65 offers the advantage of spacing the pliant sheet of the side and end walls of the liner from such rough areas or burrs. In the case of the container bottom the intervening presence of external stiffener affords this protection throughout the use of the liner. In the case of the side walls the pliant sheet is protected during the placement of the liner in the container by the periphery of external stiffener 65 when it is bonded to the exterior of the closed end wall at least in the region of its perimeter and over essentially the entire perimeter provided it is in registry with the internal stiffener 44 and of the same lateral dimensions. A further protection in mounting the liner is afforded where the external stiffener 65 has lateral dimensions somewhat in excess of the internal stiffener, typically extending about one-quarter inch beyond the perimeter of the internal stiffener, as represneted in FIGS. 10 and 11 by the region 66.

Other advantages of the liner form of FIGS. 10 and 11 include the increased ease of mounting of the liner provided by the concentration of weight in the base portion thereof due to stiffener 65 to cause it to drop and settle into the bottom of the container. It also permits a thinner and thus less expensive internal stiffener 44 without loss of the advantage of preventing liner displacement, particularly where the bond extends over essentially the entire mating faces of the exposed regions of the outer wall of the closed end region and the external stiffener 65, as where a bond of water base latex glue is formed with an adhesive such as Hughes Glue HC-3494 obtained from Hughes Chemical Corp., Detroit, Michigan.

It should be noted that the enlarged section view of FIG. 11 is a diagrammatic representation of the bottom structure wherein the pliant, thin walled material of the liner sides 41 and its extension portions into the closed end 42 with the several folds of the ears 53 and 54 are all represented as spaced apart single lines offset from each other except at the fusion joints 45 and 46 to internal liner 44. In the actual construction these layers of thin walled material are in face to face contact and produce an essentially flat region intermediate the sandwich of internal stiffener 44 and external stiffener 65 to make up the base of the liner. The adhesive bonds external stiffener 65 to the outer face of the closed end 42 including ears 53, 54, 61, 62, 63 and 64 and the single wall thicknesses between those ears to provide essentially continuous bonding over the entire area in the preferred form and at least bonding over essentially the entire peripheral region of outer stiffener 65 in any arrangement employing that stiffener.

The above described liner 12 and the method of lining a container results in a leak-proof reuseable container useful for storing and dispensing fluids which may have to be agitated within the container. The liner 12 is replaceable because it is readily collapsed for removal and insertion while being maintained in fixed contact with the walls of the container when in use.

In accordance with the provisions of the patent statutes, the principle and mode of operation of the liner has been explained and what is considered to represent its best embodiment has been illustrated and described. It should, however, be understood that the invention may be practiced otherwise than as specifically illustrated and described without departing from its spirit or scope.

What is claimed is:

1. A unitary replaceable liner for a liquid container having side walls and a bottom, the liner being adapted to accommodate suction withdrawal and mechanical agitation of liquid contained thereby in the vicinity of the container bottom and comprising:

a pliant collapsible tubular portion having an opening at one end thereof;

a closed end wall having the pliant collapsible character of said tubular portion at the end of said tubular portion opposite said opening;

a base including an internal stiffener of a generally planar form independent of said tubular portion, and bonded generally around the periphery of said base to the inside of said closed end of said tubular portion, said internal stiffener conforming to the bottom of the container and providing clearance between said liner around the periphery of said internal stiffener and the side walls of the container for passage into the container of said liner, said tubular portion being conformable to the interior side walls of the container, said entire internal liner being stiff and non-collapsible under the forces imposed in suction withdrawal and mechanical agitation of the liquid contained by said liner throughout the planar dimension thereof to maintain said tubular portion in conformity with the side wall of the container and prevent collapse of said liner in the vicinity of the container bottom, said liner being impervious and inert to the liquid in the container to maintain separation between the liquid and the container; and an external stiffener bonded to said closed end over substantially the entire periphery of said base and in general registry with said internal stiffener.

2. A unitary replaceable liner for a liquid container having side walls and a bottom, the liner being adapted to accommodate suction withdrawal and mechanical agitation of liquid contained thereby in the vicinity of the container bottom and comprising:

a pliant collapsible tubular portion of a fusible plastic film having an opening at one end thereof;

a closed end wall including a straight fused seam normal to the longitudinal dimension of said tubular portion and having the pliant collapsible character of said tubular portion at the end of said tubular portion opposite said opening, wherein portions of said closed end wall at the end of said fused seam is folded in upon the end wall along lines transverse of said seam; and a base including an internal stiffener of a fusible plastic of a generally planar form independent of said tubular portion, and bonded generally around the periphery of said base to the inside of said closed end of said tubular portion by fused junctions of single layers of said wall and said internal stiffener free of said folded portions, said internal stiffener conforming to the bottom of the container and providing clearance between said liner around the periphery of said internal stiffener and the side walls of the container for passage into the container of said liner, said tubular portion being conformable to the interior side walls of the container, said entire internal liner being stiff and non-collapsible under the forces imposed in suction withdrawal and mechanical agitation of the liquid contained by said liner throughout the planar dimension thereof to maintain said tubular portion in conformity with the side wall of the container and prevent collapse of said liner in the vicinity of the container bottom, said liner being impervious and inert to the liquid in the container to maintain separation between the liquid and the container.

3. The liner in accordance with claim 2 wherein an external stiffener is bonded to said closed end and the folded portions thereof over substantially the entire periphery of said closed end.

* * * * *